US012188232B2

(12) United States Patent
Jessop

(10) Patent No.: US 12,188,232 B2
(45) Date of Patent: Jan. 7, 2025

(54) CONCRETE FORM SYSTEMS, DEVICES, AND RELATED METHODS

(71) Applicant: ICF Building Systems LLC, South Jordan, UT (US)

(72) Inventor: Alma Jessop, South Jordan, UT (US)

(73) Assignee: ICF Building Systems LLC, South Jordan, UT (US)

( * ) Notice: Subject to any disclaimer, the term of this patent is extended or adjusted under 35 U.S.C. 154(b) by 91 days.

(21) Appl. No.: 17/841,942

(22) Filed: Jun. 16, 2022

(65) Prior Publication Data

US 2023/0407636 A1 Dec. 21, 2023

(51) Int. Cl.
*E04C 3/34* (2006.01)
*E04B 1/20* (2006.01)
*E04C 3/00* (2006.01)

(52) U.S. Cl.
CPC . *E04C 3/34* (2013.01); *E04B 1/20* (2013.01)

(58) Field of Classification Search
CPC ..... E04C 3/34; E04B 1/20
USPC ..... 52/309.12
See application file for complete search history.

(56) References Cited

U.S. PATENT DOCUMENTS 1,079,152 A * 11/1913 Stentzel ..... E04B 1/04 52/250
1,120,104 A * 12/1914 Thomas ..... E01D 4/00 52/87
1,301,561 A * 4/1919 Hirschthal ..... E04B 1/3211 264/32
1,327,889 A * 1/1920 Thomas ..... E01D 4/00 52/87
1,564,888 A * 12/1925 Orlopp ..... E04G 17/12 428/595
1,929,478 A * 10/1933 Bunker ..... E04C 2/426 404/70
1,964,816 A * 7/1934 Graydon ..... E04C 2/06 52/600
1,994,724 A * 3/1935 Neely ..... E04C 5/18 404/136

(Continued)

FOREIGN PATENT DOCUMENTS

CN 203834733 U 9/2014
DE 2546769 A1 * 4/1977 ..... E04B 5/263

(Continued)

*Primary Examiner* — Brian D Mattei
*Assistant Examiner* — Joseph J. Sadlon
(74) *Attorney, Agent, or Firm* — Workman Nydegger

(57) ABSTRACT

A concrete form system includes a concrete form and a rebar tree. The concrete form includes at least one support column disposed at a lower portion of the concrete form and first and second connection branches disposed at an upper portion or the concrete form. The first and second connection branches are configured to be connected to second and first connection branches, respectively, of another concrete form. The first and second connection branches at least partially form one or more channels therebetween. The rebar tree includes a rebar mounting assembly configured to hold one or more pieces of rebar in one or more desired positions. The rebar mounting assembly is configured to be disposed within at least one of the one or more channels at least partially formed by the first and second connection branches.

20 Claims, 7 Drawing Sheets

(56) References Cited

U.S. PATENT DOCUMENTS 2,003,670 A * 6/1935 Walker ..... A47B 65/10 108/42
2,017,832 A * 10/1935 Hovey ..... E01D 19/125 52/339
3,173,226 A * 3/1965 Solnick ..... E04B 5/14 52/607
3,475,529 A * 10/1969 Lacy ..... B28B 23/028 52/223.6
3,475,873 A * 11/1969 Steadman ..... E04B 1/20 52/444
3,552,076 A * 1/1971 Gregori ..... E04B 2/8611 52/438
3,566,560 A * 3/1971 Wakefield et al. ..... E04B 1/043 52/432
3,842,557 A * 10/1974 Brown ..... E04C 3/36 D25/60
4,041,664 A * 8/1977 Davis, Jr. ..... B28B 23/00 52/223.8
4,059,931 A * 11/1977 Mongan ..... E04C 5/122 52/79.12
4,142,705 A * 3/1979 Miller ..... E04G 21/12 249/188
4,205,029 A * 5/1980 Forrest ..... E01D 2/04 52/223.6
4,206,267 A * 6/1980 Jungbluth ..... B32B 3/28 428/626
4,300,320 A * 11/1981 Rooney ..... E01D 2/00 52/378
4,333,285 A * 6/1982 Koizumi ..... E04B 5/43 52/319
4,486,996 A * 12/1984 Alejos ..... B29C 70/72 29/445
4,514,949 A 5/1985 Crespo
4,602,467 A * 7/1986 Schilger ..... E04C 2/284 52/319
4,634,359 A * 1/1987 Sartorio ..... E04B 2/8617 249/161
4,885,884 A * 12/1989 Schilger ..... E04B 5/29 52/354
4,930,278 A * 6/1990 Staresina ..... E04F 13/0862 52/600
4,989,382 A * 2/1991 Spronken ..... E04H 13/006 52/134
5,216,866 A * 6/1993 Ekedal ..... E04C 5/168 52/684
5,367,845 A * 11/1994 Hartling ..... E02D 27/02 52/294
5,425,152 A * 6/1995 Teron ..... E01D 2/00 14/24
5,553,430 A * 9/1996 Majnaric ..... E01D 11/00 52/428
5,561,957 A * 10/1996 Gauthier ..... E04B 5/23 52/332
5,709,060 A * 1/1998 Vaughan ..... E04B 2/54 52/693
5,746,036 A * 5/1998 Angelette ..... E02D 27/42 52/294
5,755,981 A * 5/1998 Payne ..... E04G 13/066 249/23
5,826,381 A * 10/1998 Sasaki ..... E04B 5/14 52/263
5,852,907 A * 12/1998 Tobin ..... E04B 2/8652 249/40
5,987,680 A * 11/1999 Sakaya ..... E01D 19/125 404/70
6,027,094 A * 2/2000 Tian ..... E04G 15/065 52/576
6,041,561 A * 3/2000 LeBlang ..... E04B 7/20 52/234
6,151,856 A * 11/2000 Shimonohara ..... F16B 19/002 52/426
6,161,360 A * 12/2000 Smith ..... E04C 5/168 52/165
6,272,749 B1 * 8/2001 Boeshart ..... E04B 5/36 29/897.34
6,293,063 B2 * 9/2001 Van Doren ..... E04B 5/14 52/250
6,385,930 B1 * 5/2002 Broms ..... E04B 5/43 52/223.6
6,460,213 B1 * 10/2002 Flint ..... E01F 5/005 52/309.12
6,530,553 B1 * 3/2003 Diorio ..... E04G 11/10 52/79.11
6,536,172 B1 * 3/2003 Amend ..... E04B 2/8617 52/432
6,568,139 B2 * 5/2003 Bot ..... E04B 5/04 52/250
6,625,948 B2 * 9/2003 Valente ..... E04B 5/36 52/745.1
6,729,094 B1 * 5/2004 Spencer ..... E04B 5/10 52/354
6,742,211 B2 * 6/2004 Copher ..... E01D 19/02 14/75
6,761,007 B2 * 7/2004 Lancelot, III ..... E04C 2/34 52/309.7
6,837,017 B2 * 1/2005 Hardy, Jr. ..... E01C 11/18 404/136
7,159,262 B2 * 1/2007 Jackson ..... E01D 21/00 248/242
7,191,572 B2 * 3/2007 Izquierdo ..... E04B 5/32 52/699
7,353,642 B1 * 4/2008 Henriquez ..... E04B 7/02 52/404.1
7,661,231 B2 * 2/2010 Dalton ..... E04B 1/161 52/236.7
7,810,293 B2 * 10/2010 Gibbar ..... E04C 2/288 52/432
7,954,291 B2 * 6/2011 Cretti ..... E04B 5/36 52/332
7,963,080 B1 * 6/2011 Bowman ..... B32B 27/42 52/309.7
8,074,419 B1 * 12/2011 Humphress ..... E04B 2/46 446/124
8,122,660 B2 * 2/2012 Kekanovic ..... E04B 5/21 52/448
8,291,676 B2 * 10/2012 Hong ..... E04C 3/293 52/340
8,453,406 B2 * 6/2013 Platt ..... E04C 3/294 14/73.1
8,464,482 B2 * 6/2013 Raynor ..... E04C 3/34 52/169.9
8,495,846 B2 * 7/2013 Bravinski ..... E04B 5/48 52/340
8,544,227 B2 * 10/2013 Gullette ..... E04G 15/061 52/297
8,646,232 B2 * 2/2014 Liskey ..... E04C 3/34 52/294
8,752,348 B2 * 6/2014 Bowman ..... B32B 3/06 52/309.3
8,943,771 B2 * 2/2015 Garcia ..... E04B 5/14 52/33
9,217,248 B2 * 12/2015 Knepp ..... E02D 27/42
9,447,574 B2 * 9/2016 Espinosa ..... E04B 1/4121
9,580,920 B1 * 2/2017 Yingling ..... E04C 3/20
9,683,361 B2 * 6/2017 Timberlake ..... E04B 1/167
9,822,527 B1 * 11/2017 Ruga ..... B28B 7/348
9,890,531 B2 * 2/2018 Liberman ..... E04B 2/42
10,125,468 B2 * 11/2018 Henriquez ..... E04G 9/05
10,301,838 B1 * 5/2019 Karakas ..... E04C 5/0609
10,309,108 B2 * 6/2019 Sanabra Loewe ..... E04B 5/06
10,323,368 B2 * 6/2019 Mullaney ..... E02D 27/016
10,329,729 B2 * 6/2019 Teague ..... E02D 5/04
10,344,480 B2 * 7/2019 Azizinamini ..... E04C 3/20
10,378,204 B2 * 8/2019 Gosain ..... E04B 2/8652
10,557,264 B2 * 2/2020 Zavitz ..... E04C 3/293
10,563,400 B2 * 2/2020 Graham ..... B32B 3/20
10,597,863 B2 * 3/2020 Slaven, Jr. ..... E04B 1/043

(56) References Cited

U.S. PATENT DOCUMENTS 10,704,222 B2 * 7/2020 Grussenmeyer .... E04G 23/0229
10,718,114 B2 * 7/2020 Park ..... C04B 28/02
10,760,260 B2 * 9/2020 Yin ..... E04B 1/04
10,787,827 B2 * 9/2020 Crosby ..... E04G 17/0754
10,935,333 B2 * 3/2021 Guarrero ..... C09K 5/14
10,968,653 B2 * 4/2021 Vemuri ..... E04H 9/025
11,035,114 B2 * 6/2021 Mori ..... E04B 1/10
11,118,360 B2 * 9/2021 Thompson ..... E04G 15/061
11,391,052 B2 * 7/2022 Lamm ..... E04C 5/16
11,536,017 B2 * 12/2022 VanHoose ..... E03F 5/10
11,686,084 B2 * 6/2023 Chen ..... E04B 1/215
52/745.19
11,718,964 B2 * 8/2023 Ogorchock ..... E01D 19/125
14/73
2004/0237439 A1 * 12/2004 Powell ..... E04B 1/34823
52/505
2005/0108976 A1 5/2005 Trangsrud
2005/0262796 A1 * 12/2005 Wilson ..... E04C 5/168
52/677
2006/0272267 A1 * 12/2006 Mentado-Duran ..... E04C 3/26
52/693
2007/0044423 A1 * 3/2007 Funk ..... E04C 5/20
52/714
2008/0041004 A1 * 2/2008 Gibbar ..... E04C 2/288
52/309.12
2009/0145074 A1 * 6/2009 Tsukamoto ..... E04C 5/166
52/686
2012/0079783 A1 4/2012 Nylin
2013/0074430 A1 * 3/2013 Morcous ..... E04B 5/265
52/252
2015/0013255 A1 * 1/2015 Hunt ..... E04B 1/043
52/250
2015/0368901 A1 12/2015 Weber
2017/0241139 A1 * 8/2017 Moyano ..... E04B 1/06
2017/0356177 A1 * 12/2017 Lee ..... E04B 1/58
2019/0048555 A1 * 2/2019 Jahnke ..... E02D 27/08
2019/0177964 A1 * 6/2019 Yousefi Darestani .....
E04G 17/002
2022/0412082 A1 * 12/2022 Hebert ..... E04B 5/38
2023/0040469 A1 * 2/2023 Mathe ..... E04B 1/48
2023/0417041 A1 * 12/2023 Zavitz ..... E04C 3/34

FOREIGN PATENT DOCUMENTS

DE 102016001183 A1 * 3/2016 ..... B32B 13/10
EP 0013570 A1 * 7/1980 ..... E04F 15/02476
FR 2676240 A1 * 11/1992 ..... E01D 1/00
FR 2903437 A1 * 1/2008 ..... E01D 19/02
GB 1211716 A * 11/1970 ..... E04B 1/21
GB 2246148 A * 1/1992 ..... E04B 5/263
KR 20090124721 A * 12/2009 ..... E04B 1/20
WO WO-2015085367 A1 * 6/2015 ..... E01D 19/125
WO WO-2016161478 A1 * 10/2016 ..... E04B 9/00
WO WO-2017204720 A1 * 11/2017

* cited by examiner

CONCRETE FORM SYSTEMS, DEVICES, AND RELATED METHODS

BACKGROUND

Technical Field

The present disclosure relates to concrete form systems and devices, and related methods. More specifically, the present disclosure relates to concrete form systems and devices, and related methods that can be used to form structural concrete floors, or flat to slightly pitched roofs.

The Relevant Technology

Concrete is frequently used in the construction industry. For instance, concreate is commonly used in various aspects of building construction, including to form foundations, floors, ceiling, roofs, and walls. In such applications, cast-in-place concreate is frequently used. Concrete can be poured into a form and held in place by the form while the concrete cures. Once the concrete has sufficiently cured, the form may be removed or stripped from the concrete. This may include removing any bracing and form members.

While concrete, especially reinforced concrete, can be used to construct strong, stable buildings, there are some challenges encountered with concrete. For instance, when concrete is used to form a floor/ceiling between different stories of a building, ductwork, piping, and other conduits (e.g., for running cables, etc.) are often attached to the lower surface thereof (i.e., the surface that forms the ceiling). The ductwork, piping, and other conduits are then typically enclosed within drywall or other materials to hide them from sight. However, this can result in ceilings with undesirable appearances due to various portions being lower than other portions.

Additionally, concrete can have relatively low insulative properties (i.e., relatively low R-value), that make it difficult to efficiently control the climate within the building. For instance, it may be difficult to maintain different levels of a building at desired temperatures because heat from lower levels may rise through the concrete floors/ceilings to upper floors.

Accordingly, there are a number of problems in the art that need to be addressed. The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

The present disclosure relates to concrete form systems and devices, and related methods. More specifically, the present disclosure relates to concrete form systems and devices, and related methods that can be used to form structural concrete floors, or flat to slightly pitched roofs.

In one example embodiment of the present disclosure, a concrete form system according to one example embodiment may include a concrete form and a rebar tree. The concrete form may include at least one support column disposed at a lower portion of the concrete form and first and second connection branches disposed at an upper portion or the concrete form. The first and second connection branches may be configured to be connected to second and first connection branches, respectively, of another concrete form.

The first and second connection branches may at least partially form one or more channels therebetween. The rebar tree may include a rebar mounting assembly configured to hold one or more pieces of rebar in one or more desired positions. The rebar mounting assembly may be configured to be disposed within at least one of the one or more channels at least partially formed by the first and second connection branches.

In another example embodiment of the present disclosure, a concrete form includes first and second support columns, a bridge portion, and first and second connection branches. The bridge portion may extend upwardly from and between the first and second support columns to connect the first and second support columns to one another. The bridge portion and the first and second support columns may cooperate to define a channel in a lower surface of the concrete form. The first connection branch may extend upwardly from the first support column. The first connection branch and the bridge portion may cooperate to define a first channel in an upper surface of the concrete form. The second connection branch may extend upwardly from the second support column. The second connection branch and the bridge portion may cooperate to define a second channel in an upper surface of the concrete form.

In a further example embodiment of the present disclosure, a rebar tree that includes a shaft and a rebar mounting assembly. The rebar mounting assembly may be selectively and movably disposed on the shaft. The rebar mounting assembly includes one or more branches, each having one or more rebar retention elements configured to hold one or more pieces of rebar in one or more desired positions.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Additional features and advantages of the disclosed embodiments will be set forth in the description which follows, and in part will be obvious from the description, or may be learned by the practice of the disclosure. These and other features will become more fully apparent from the following description and appended claims or may be learned by the practice of the present disclosure.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The present disclosure relates to concrete form systems and devices, and related methods. More specifically, the present disclosure relates to concrete form systems and devices, and related methods that can be used to form structural concrete floors or flat to slightly pitched roofs.

Figure 1:
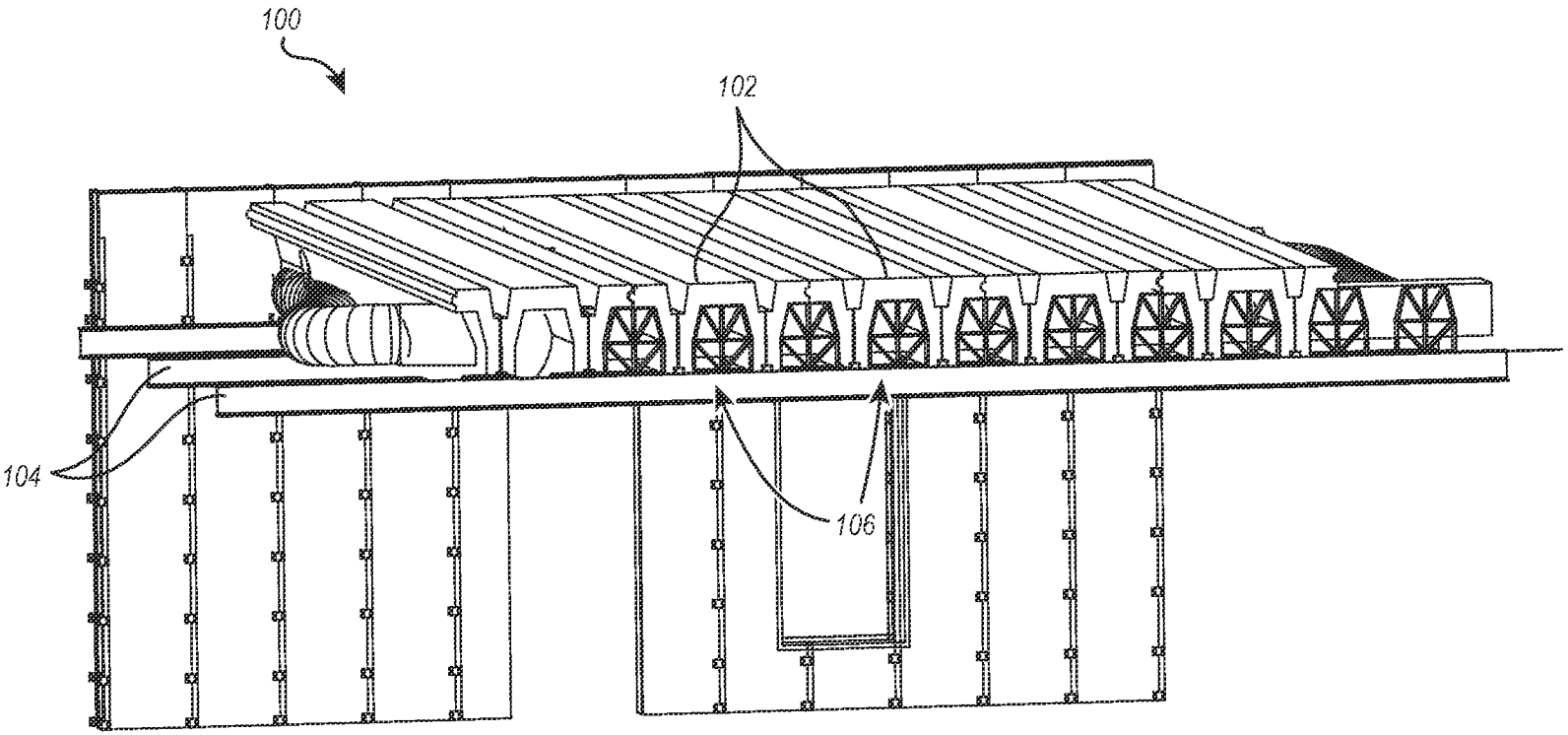
FIG. 1 illustrates an example embodiment of concrete form system.

FIG. 1 illustrates an example embodiment of a concrete form system 100 that may be used to construct a structurally sound concrete floor or flat to slightly pitched roof in a building. In the illustrated embodiment, the form system 100 includes a plurality of concrete forms 102. While discussed in greater detail below, the concrete forms 102 may be positioned adjacent and/or secured to one another to create a concrete form of a desired size (e.g., the size of the concrete floor that is being formed).

The concrete form system 100 may also include temporary shoring elements 104 and/or roll bucks 106 that may be designed to support the concrete forms 102 while the concrete forms 102 are put into place, while concrete is poured therein/thereon, and while the concrete cures.

As in the illustrated embodiment, the temporary shoring elements 104 may include beams that are held in horizontal positions to support the concrete forms 102 thereon at a desired height. Although not illustrated, the temporary shoring elements 104 may be held in place by one or more posts or other temporary or permanent support elements.

The roll bucks 106 may be disposed at least partially within a channel or recess formed within a single concrete form 102 or a channel or recess formed by adjacent concrete forms 102. As can be seen in FIG. 1, the roll bucks 106 may be positioned on and supported by the temporary shoring elements 104. With the support of the temporary shoring elements 104, the roll bucks 106 can provide additional structural support to the concrete forms 102 while concrete is poured thereon and while the concrete cures.

Once the concrete has sufficiently cured, the temporary shoring elements 104 and the roll bucks 106 may be removed, leaving in place the concrete forms 102 and the cured concrete. With the temporary shoring elements 104 and the roll bucks 106 removed from underneath the concrete forms 102, various components may be secured to or within the underside of the concrete forms 102. For instance, HVAC ductwork, plumbing pipes, electrical conduits, etc. may be attached to or run through the concrete forms 102. Additional details regarding this aspect of the concrete form system 100 will be provided below.

With continued attention to FIG. 1, attention is also now directed to FIGS. 2-6, which illustrate perspective, end, side, top, and bottom views, respectively, of a concrete form 102 apart from the rest of the system 100. While the concrete form 102 is illustrated and described as having multiple various features, it will be appreciated that the illustrated embodiment is merely exemplary. The present disclosure contemplates any concrete form that includes one or more of the features disclosed herein in connection with concrete form 102.

Figure 2:
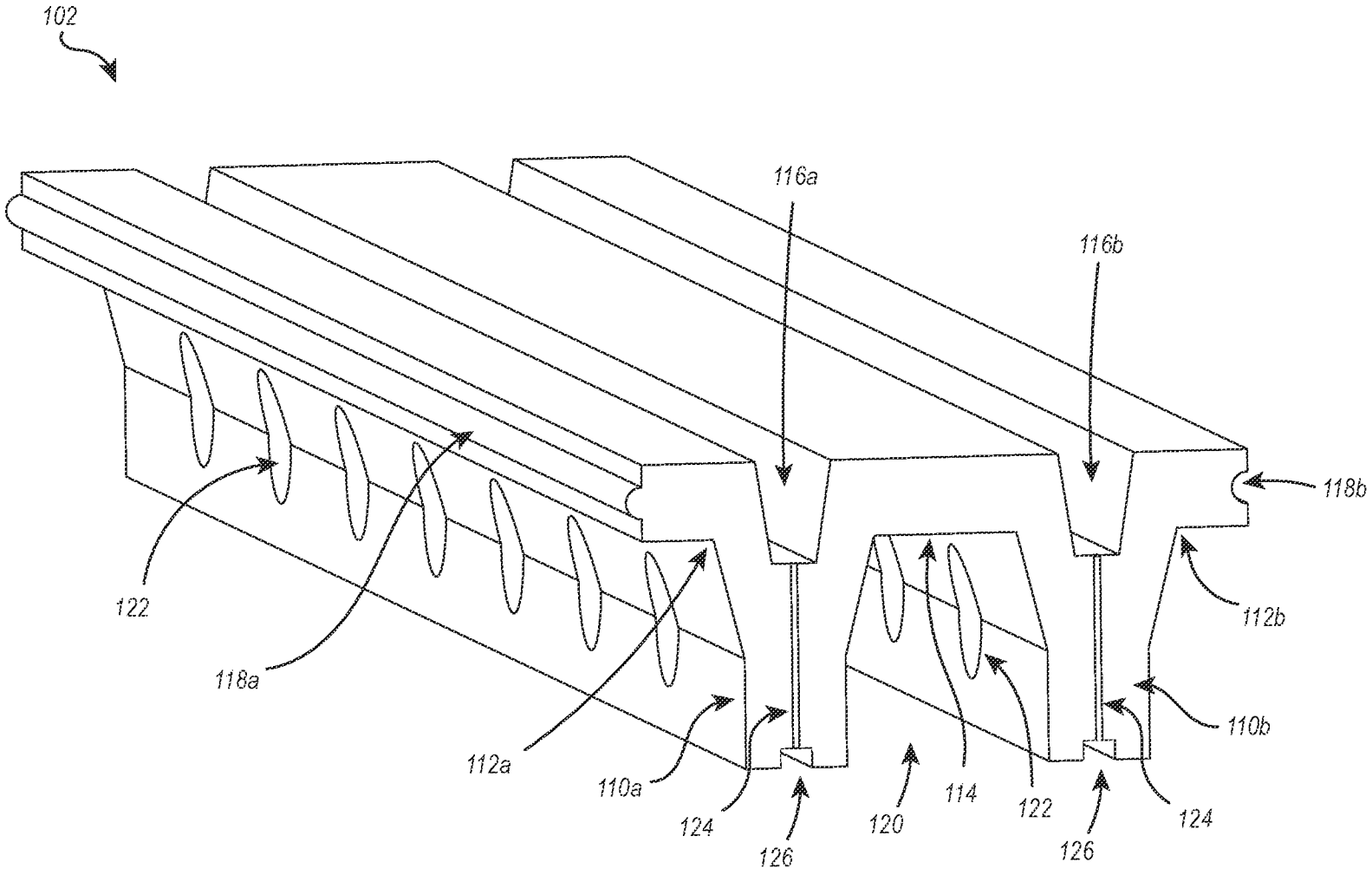
FIG. 2 illustrates a perspective view of an example embodiment of a concrete form usable in the concrete form system of FIG. 1.
Figure 3:
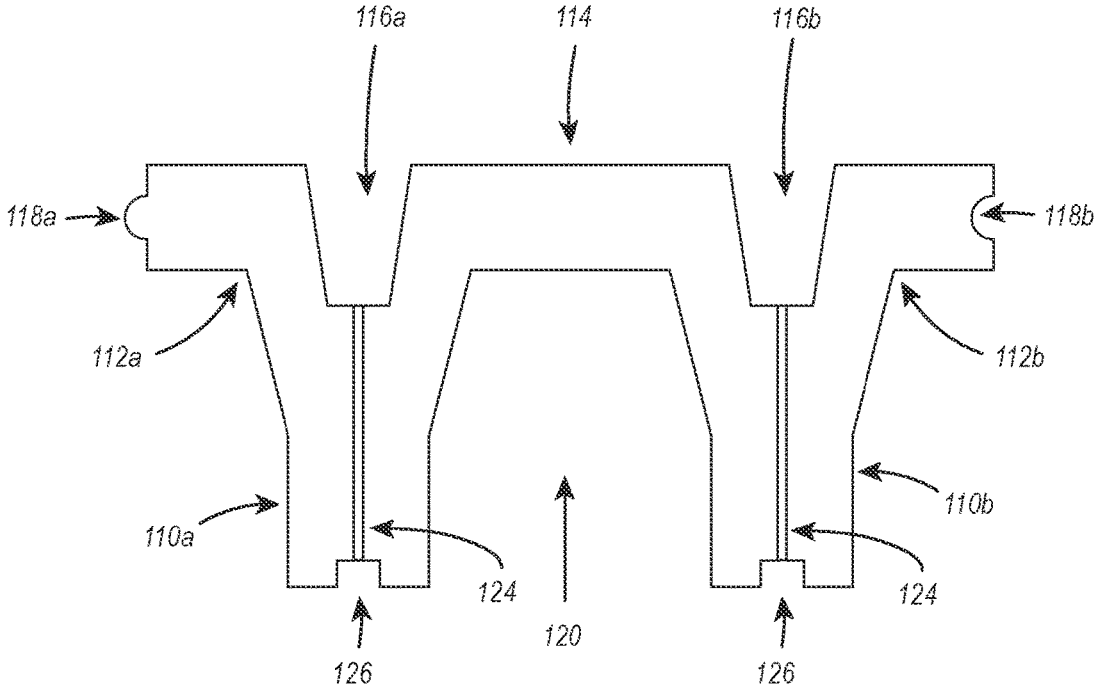
FIG. 3 illustrates an end view of the concrete form of FIG. 2.

As can be seen in FIGS. 2 and 3, the end of the concrete form 102 has a generally W or connected YY profile. That is, the concrete form 102 has first and second support columns 110*a*, 110*b*, first and second connection branches 112*a*, 112*b*, and a bridge portion 114. The bridge portion 114 is connected between the first and second support columns 110*a*, 110*b*. The first connection branch 112*a* and the bridge portion 114 extend upwardly from the first support column 110*a*. Additionally, the first connection branch 112*a* and the bridge portion 114 extend laterally away from one another so as to form a channel 116*a* therebetween. Similarly, the second connection branch 112*b* and the bridge portion 114 extend upwardly from the second support column 110*b* and laterally away from one another so as to form a channel 116*b* therebetween. As can be seen in the Figures, the channels 116*a*, 116*b* are disposed directly above the first and second support columns 110*a*, 110*b*, respectively, The first and second connection branches 112*a*, 112*b* and the bridge portion 114 cooperate to define an upper surface of the concrete form 102. The channels 116*a*, 116*b* are recessed from the upper surface of the concrete form 102 so as to be able to receive concrete therein.

The first and second connection branches 112*a*, 112*b* include connection feature 118*a*, 118*b*, respectively. When multiple concrete forms 102 are positioned adjacent to one another, the connection feature 118*a* on one concrete form 102 may mate with the connection features 118*b* on an adjacent concrete form 102, as illustrated in FIG. 1.

In some embodiments, the connection features 118*a*, 118*b* may facilitate a secure temporary or permanent connection between adjacent concrete forms 102. In other embodiments, the connection features 118*a*, 118*b* may facilitate alignment between adjacent concrete forms 102 when the concrete form system 100 is being assembled. In still other embodiments, the connection features 118*a*, 118*b* may facilitate both alignment and secure connections between adjacent concrete forms 102.

In the illustrated embodiment, the connection feature 118*a* of the first connection branch 112*a* is a tongue and the connection feature 118*b* of the second connection branch 112*b* is a groove. In other embodiments, the connection features may include any mating or other features that facilitate connection and/or alignment between adjacent concrete forms 102. For instance, the connection features 118*a*, 118*b* may include mortise and tenons, dovetails, mating under and overlaps, and the like.

The first and second support columns 110*a*, 110*b* cooperate to define a lower surface of the concrete form 102. As can be seen in FIGS. 2 and 3, the first and second support columns 110*a*, 110*b* and the bridge portion 114 cooperate to form a channel 120 in an underside of the concrete form 102. The channel 120 is recessed from the lower surface of the concrete form 102.

Similarly, when two concrete forms 102 are positioned adjacent to one another, the two concrete forms 102 may cooperate to form another channel 120. That is, the first support column 110*a* and first connection branch 112*a* from one concrete form 102 may form a portion (e.g., half) of a channel 120. The second support column 110*b* and the second connection branch 112*b* from another concrete form 102 may form another portion (e.g., half) of a channel 120. More specifically, the first support column 110*a* and first connection branch 112*a* from one of the concrete forms 102 and the second support column 110*b* and second connection branch 112*b* from the other concrete form 102 may cooperate to form a channel 120. The channel 120 formed by two concrete forms 102 may be recessed from the lower sides of both concrete forms 102. As will be discussed in greater detail below, HVAC ductwork, plumbing, and/or electrical conduit may be run through the channels 120.

Figure 4:
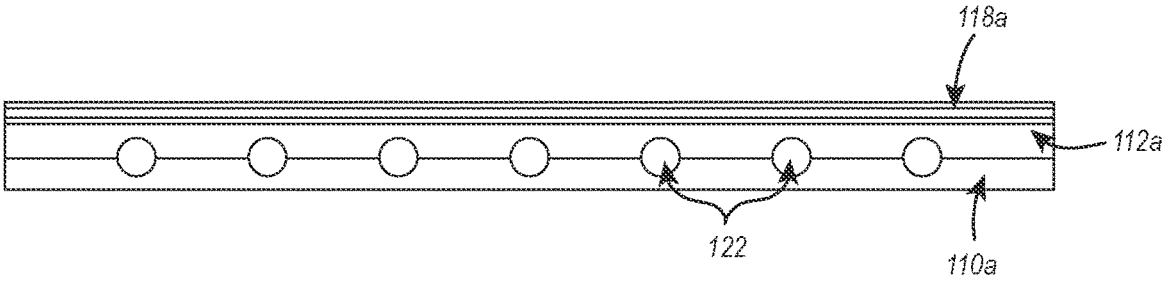
FIG. 4 illustrates a side view of the concrete form of FIG. 2.

As can best be seen in FIGS. 2 and 4, one or more apertures 122 may extend (horizontally) through (e.g., between opposing sides of) the first and/or second support columns 110*a*, 110*b*. In the illustrated embodiment, the apertures 122 are circular and evenly spaced along the lengths of the first and second support columns 110*a*, 110*b*. In other embodiments, the apertures 122 may have other shapes. Likewise, the number and placement of the apertures 122 may vary from one embodiment to another. Furthermore, the apertures 122 in the first support column 110*a* may be aligned with or offset from the apertures 122 in the second support column 110*b*. Moreover, one of the support columns 110*a*, 110*b* may include one or more apertures 122 while the other support column may not include apertures 122 (or not the same number of apertures 122).

Figure 5:
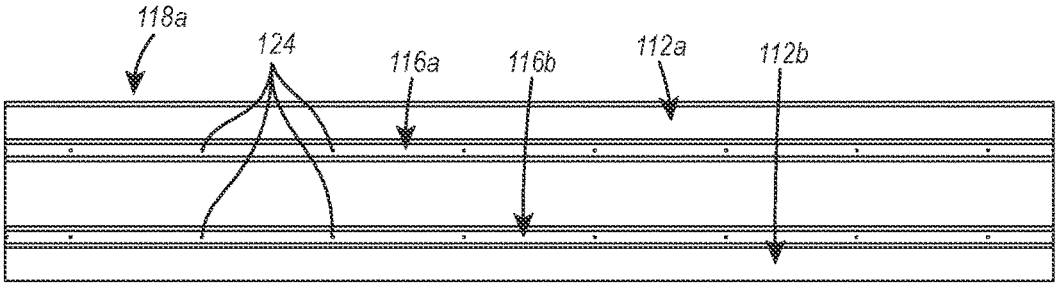
FIG. 5 illustrates a top view of the concrete form of FIG. 2.
Figure 6:
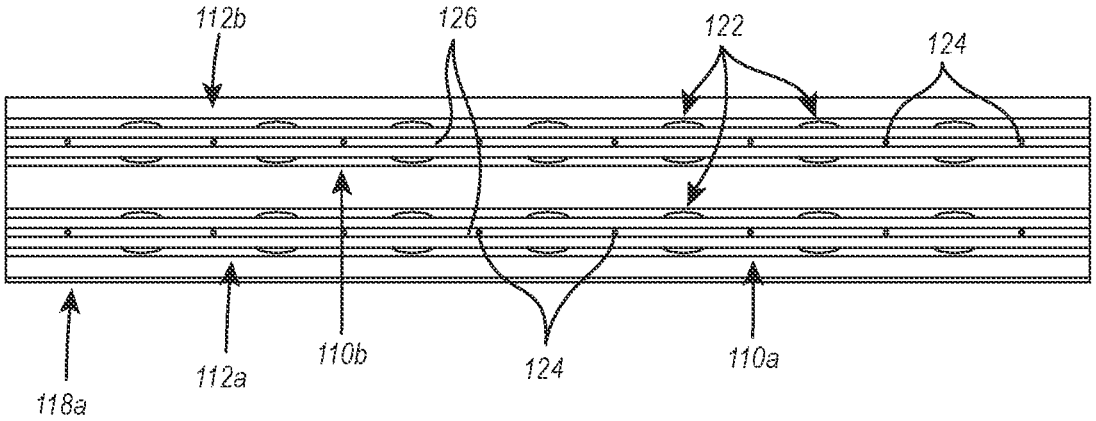
FIG. 6 illustrates a bottom view of the concrete form of FIG. 2.

As illustrated in FIGS. 2, 3, and 5, each of the support columns 110*a*, 110*b* includes one or more apertures 124 that extend (vertically) therethrough between the channels 116*a*, 116*b* and the lower ends of the support columns 110*a*, 110*b*. Additionally, as shown in FIGS. 2, 3, and 6, each of the support columns 110*a*, 110*b* may have a channel 126 formed in a lower end thereof. The channels 126 may be recessed from the lower ends of the support columns 110*a*, 110*b* and may extend along all or a portion of the length of the support columns 110*a*, 110*b*. The purpose and functionality of the apertures 124 and channels 126 will be described below in connection with FIGS. 8 and 9.

While the concrete form 102 is described and illustrated as having a W or connected YY end profile, this is merely exemplary. In other embodiments, a concrete form may include a Y end profile. In such embodiments, the concrete form may include a single support column similar or identical to support columns 110*a*, 110*b*. Extending upwardly from the support column, the concrete form may include first and second connection branches similar or identical to connection branches 112*a*, 112*b*. In such an embodiment, the concrete form would have a single channel (similar to channels 116*a*, 116*b*) recessed into the upper surface of the concrete form. The concrete form would be configured to cooperate with one or more other concrete forms for form one or more lower channels (similar to channels 120).

Figure 7:
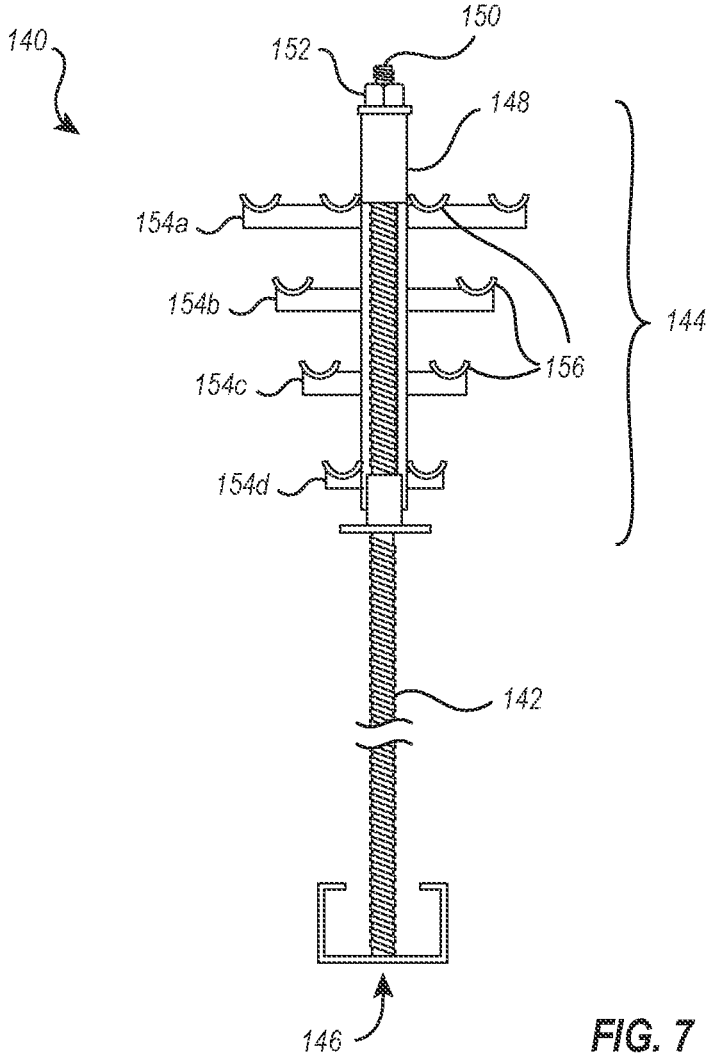
FIG. 7 illustrates a rebar tree usable with the concrete form system of FIG. 1.
Figure 8:
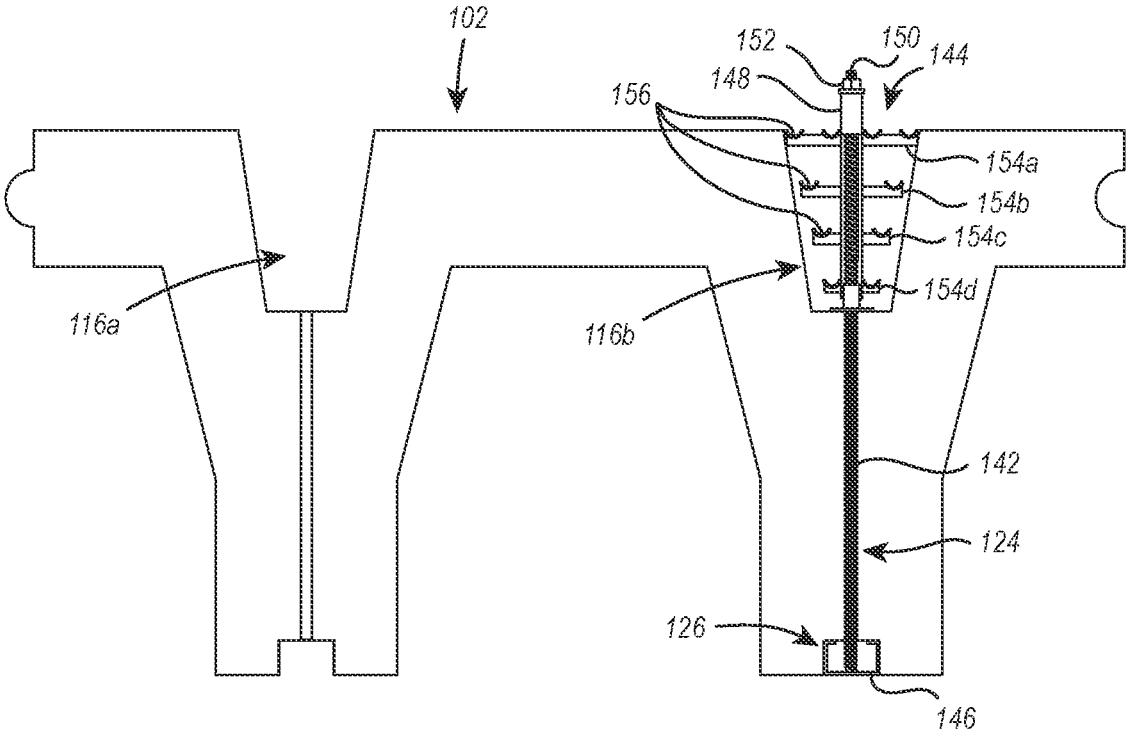
FIG. 8 illustrates the rebar tree of FIG. 7 used in the concrete form of FIGS. 2-6.
Figure 9:
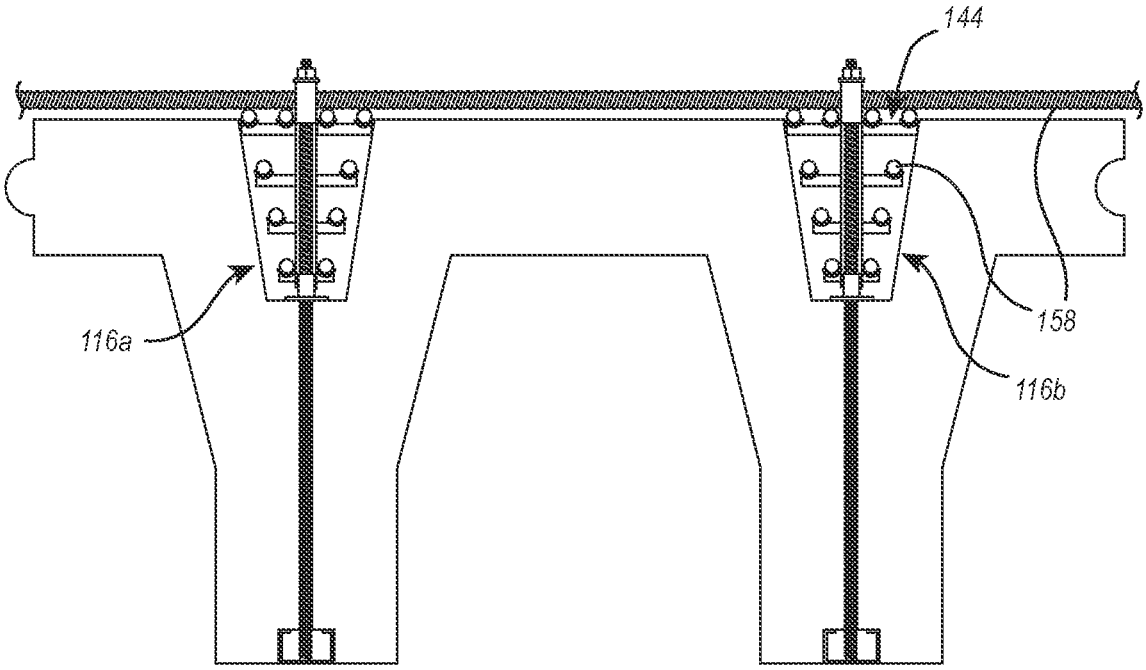
FIG. 9 illustrates the rebar tree and concrete form of FIG. 8 with rebar disposed therein.

Attention is now directed to FIGS. 7-9, which illustrate a system for positioning rebar or other reinforcement elements in desired locations within channels 116*a*, 116*b*. As is well understood, rebar or other reinforcement elements are commonly used in concrete to increase the strength of the concrete. As is also well understood, the rebar or other reinforcement elements need to be properly positioned within the concrete to provide the desired benefit.

When creating a concrete floor with the concrete form system 100, the system 100 is assembled and concrete is poured over the top of the concrete forms 102. The concrete fills the channels 116*a*, 116*b*. When cured, the concrete in the channels 116*a*, 116*b* may act as floor joists or beams. To provide the floor joists or beams sufficient strength, rebar or other reinforcement elements can be disposed within the channels 116*a*, 116*b* prior to pouring the concrete. To properly position the rebar within the channels 116*a*, 116*b*, a rebar tree 140 as shown in FIG. 7 may be used.

In the illustrated embodiment, the rebar tree 140 includes a shaft 142, a rebar mounting assembly 144 disposed on a first end or portion of the shaft 142, and a connection element 146 connected to a second end of the shaft 142. The rebar mounting assembly 144 may be movably connected to or mounted on the shaft 142. The connection element 146 may be permanently or otherwise connected to the second end of the shaft 142 such that the shaft 142 and connection element 146 are fixedly connected together.

In the illustrated embodiment, the rebar mounting assembly 144 includes a sleeve 148 that is disposed at least partially around the shaft 142. The sleeve 148 may be slidably disposed on the shaft 142 such that the sleeve 148 (and the rest of the rebar mounting assembly 144) may slide along at least a portion of the length of the shaft 142. The shaft 142 may include a threaded first end 150. A bolt 152 may be threaded onto the first end 150 of the shaft 142. As the bolt 152 is threaded further onto the shaft 142, the bolt 152 may engage the sleeve 148 and cause the sleeve 148 (and the rest of the rebar mounting assembly 144) to move down the shaft 142 towards the second end thereof (e.g., the end with the connection element 146).

The rebar mounting assembly 144 may include multiple branches connected to the sleeve 148, each with one or more rebar retention elements. In the illustrated embodiment, the rebar mounting assembly 144 includes four branches 154*a*, 154*b*, 154*c*, 154*d*. Each branch extends from opposing sides of the sleeve 148. Each branch includes one or more rebar retention elements 156. In the illustrated embodiment, the rebar retention elements 156 are channels mounted on or formed in upper surfaces of the branches 154*a*-154*d*. The channels may open upwardly such that rebar may be set into the channels. In other embodiments, the rebar retention elements 156 may be apertures that extend through the branches 154*a*-154*d*, such that the rebar may be slid into the apertures. In still other embodiments, the rebar retention elements 156 may extend downwardly from the branches 154*a*-154*d* and be configured to hold the rebar. Thus, it will be appreciated that the rebar retention elements 156 may take substantially any form so long as they can hold rebar in place while concrete is poured and cured.

The rebar tree 140 can be used in conjunction with the concrete form 102. For instance, as shown in FIG. 8, the rebar tree 140 may be disposed within the concrete form 102 such that the shaft 142 extends through one of the apertures 124 in the concrete form 102 and the rebar mounting assembly 144 is disposed within one of the channels 116*a*, 116*b*. This may be accomplished by removing the bolt 152 and the rebar mounting assembly 144 from the shaft 142. The first end of the shaft 142 may then be inserted up through the lower end of the aperture 124 until the first end of the shaft 142 is disposed in the channel 116*a*, 116*b* and the connection element 146 is disposed within the channel 126 of the concrete form 102. Thereafter, the rebar mounting assembly 144 can be disposed on the shaft 142 (e.g., by sliding the sleeve 148 onto the shaft 142). The bolt 152 can be threaded onto the threaded first end 150 of the shaft 142. As the bolt 152 is tightened, the connection element 146 is pulled into the channel 126 and the rebar mounting assembly 144 is secured between the bolt 152 and the lower surface of the channel 116*a*, 116*b*.

With the rebar mounting assembly 144 securely disposed within the channel 116*a*, 116*b*, rebar 158 may be disposed on or in the rebar retention elements 156, as shown in the channel 116*a* in FIG. 9. Optionally, additional rebar 158 can be positioned on top of the concrete forms 102, as shown as also shown in FIG. 9. Thereafter, concrete can be poured on the concrete form system 100. The concrete may fill the channels 116*a*, 116*b* and encompass the rebar 158. In FIG. 9, half of the concrete form system 100, including half of the channels 116*a*, 116*b*, are covered/filled with concrete and the rebar 158 is shown extend out of the end thereof for illustrative purposes.

Figure 10:
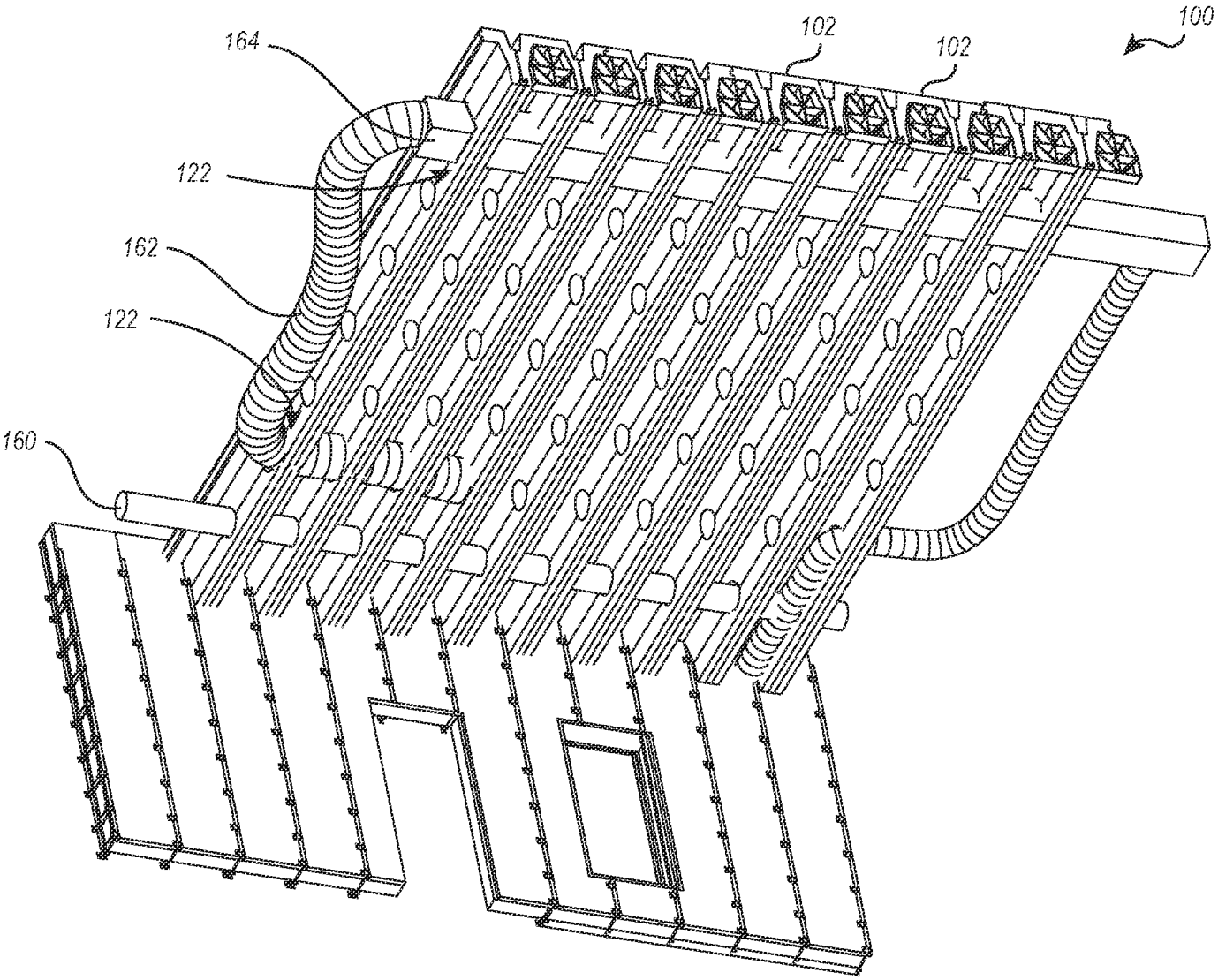
FIG. 10 illustrates an underside of the concrete form system of FIG. 1.

Attention is now directed to FIG. 10, which illustrates an underside of the concrete form system of FIG. 1. As noted above, the concrete forms 102 are designed with apertures (e.g., apertures 122) and/or with or to form channels 120 that allow for HVAC ductwork, plumbing, and electrical conduit to be run therethrough. FIG. 10 illustrates a few examples of such. For instance, FIG. 10 illustrates a pipe 160 extending through a series of apertures 122 in the support columns 110*a*, 110*b* of the various concrete forms 102. The pipe may be a plumbing drainpipe or other water conduit. Similarly, FIG. 10 illustrates HVAC ductwork 162. As with the pipe 160, the ductwork 162 also extends through a series of apertures 122 in the support columns of the concrete forms 102. Additionally, at least a portion of the ductwork 162 also extends lengthwise through at least one of the channels 120.

FIG. 10 also illustrates ductwork 164. In contrast to the circular shape of the pipe 160 and the ductwork 162, the ductwork 164 has a square cross-sectional shape. Furthermore, the dimensions of the ductwork 164 are larger than the diameter of the apertures 122. However, in the illustrated embodiment, some of the apertures 122 have been cut larger and into square shapes to accommodate the ductwork 164. This can be readily achieved because the concrete forms 102 are formed of foam that can be easily cut to accommodate substantially any type of conduit. Furthermore, since the concrete forms 102 are not relied on to provide the floor with structural integrity or strength, cutting out portions thereof does not compromise the floor.

Figure 11:
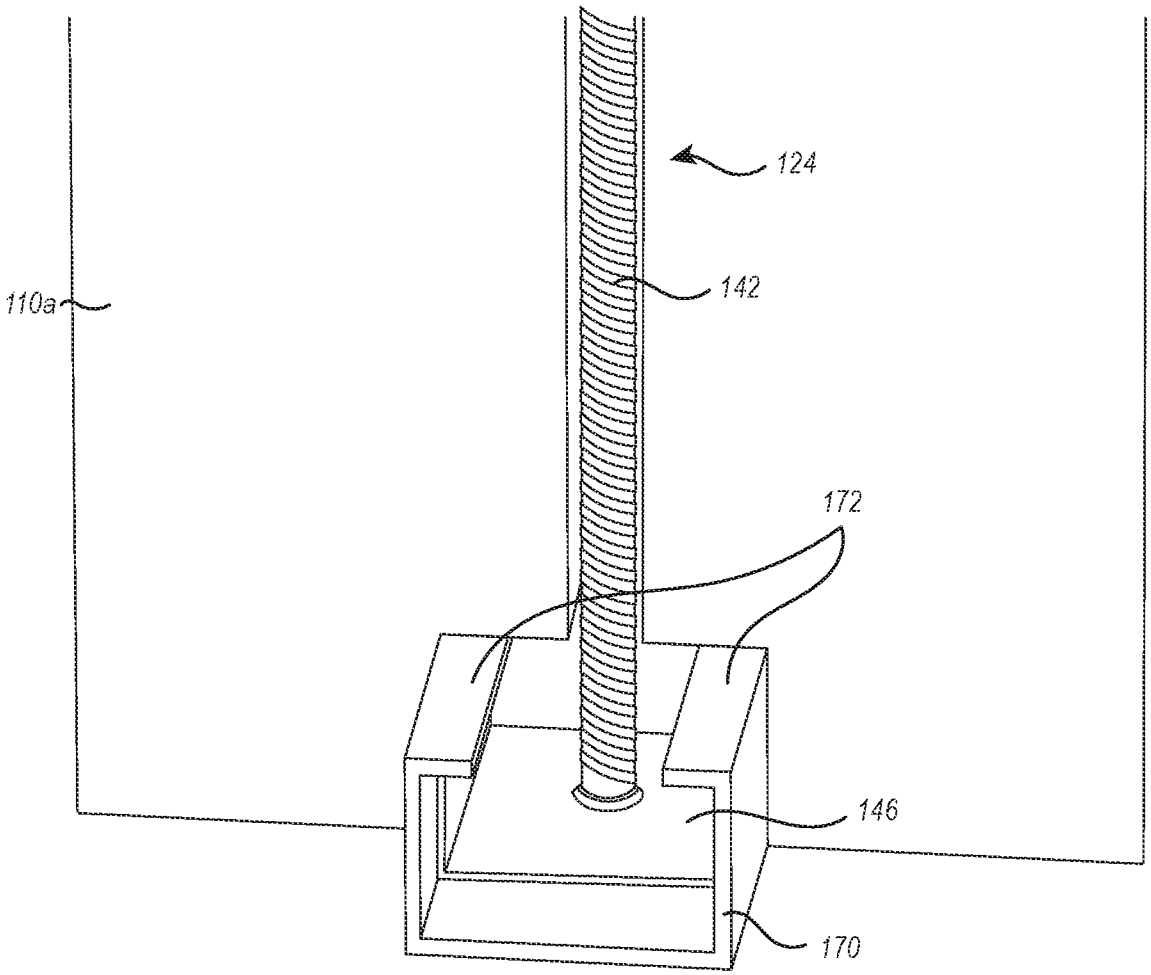
FIG. 11 illustrates an example connection between the concrete form system of FIG. 1 and a ceiling component.

Once the floor is complete and any desired conduits are run through the concrete forms 102 (or before), a ceiling or ceiling components may be attached to the underside of the concrete form system 100. The ceiling or ceiling components may be attached to the concrete form system 100 via the connection elements 146 of the rebar tree 140. FIG. 11 illustrates one example embodiment of how a ceiling component can be connected to the connection element 146.

FIG. 11 illustrates the lower end of a support column 110*a* of a concrete form 102. The shaft 142 of a rebar tree 140 extends through the aperture 124 and the connection element 146 is disposed at least partially within the channel 126. A ceiling component 170 can be connected to the connection element 146. For instance, in the illustrated embodiment, the connection element 146 has a generally U-shaped profile and the ceiling component 170 has a similar profile. However, the ceiling component 170 is slightly larger than the connection component and has inwardly extending flanges 172. The ceiling component 170 may be slid onto the connection element 146 such that the flanges 172 extend over the upper ends of the connection element 146 in a manner to secure the ceiling component 170 on the connection element 146. Connecting the ceiling component 170 to the connection element 146 secures the ceiling component 170 to the underside of the floor. The remainder of the ceiling (e.g., drywall, tiles, etc.) may be secured to the ceiling component 170 with standard fasteners (e.g., screws, adhesives, etc.).

While the previous embodiments have focused on a system that uses a concrete form 102 and a rebar tree 140, it will be appreciated that this is merely exemplary. In other embodiments, a concrete form 102 may be used without a rebar tree 140. In such embodiments, the concrete form 102 may omit the one or more apertures 124 since they would not be needed for the shafts 142 of the omitted rebar tree 140. Similarly, the channels 126 in the concrete form 102 may be omitted or modified since the connection elements 146 of the omitted rebar trees 140 would not be present.

In such embodiments, the ceiling components 170 may be molded into or otherwise connected to the concrete forms 102 (e.g., with mechanical fasteners, adhesives, etc.). Additionally, rather than using a rebar mounting assembly 144 to position rebar within the channels 116*a*, 116*b* of the concrete form 102, rebar cages (such as pre-tied rebar cages) may be positioned within the channels 116*a*, 116*b* and used to reinforce the concrete disposed therein.

In light of the above, a concrete form system according to one example embodiment may include a concrete form and a rebar tree. The concrete form may include at least one support column disposed at a lower portion of the concrete form and first and second connection branches disposed at an upper portion or the concrete form. The first and second connection branches may be configured to be connected to second and first connection branches, respectively, of another concrete form. The first and second connection branches may at least partially form one or more channels therebetween. The rebar tree may include a rebar mounting assembly configured to hold one or more pieces of rebar in one or more desired positions. The rebar mounting assembly may be configured to be disposed within at least one of the one or more channels at least partially formed by the first and second connection branches.

In some embodiments, the at least one support column comprises first and second support columns.

In some embodiments, the concrete form also includes a bridge portion extending between and connecting the first and second support columns.

In some embodiments, the first and second support columns and the bridge portion cooperate to define a channel in a lower side of the concrete form.

In some embodiments, the one or more channels at least partially formed by the first and second connection branches comprise first and second channels.

In some embodiments, the first channel is formed by the first connection branch and the bridge portion and the second channels is formed by the second connection branch and the bridge portion.

In some embodiments, the concrete form also includes an aperture extending through the at least one support column between the at least one of the one or more channels and a lower end of the at least one support column.

In some embodiments, the rebar tree also includes a shaft having a first portion on which the rebar mounting assembly is selectively mountable, the shaft being configured to extend through the aperture in the at least one support column.

In some embodiments, the rebar tree also includes a connection element disposes at a second end of the shaft.

In some embodiments, the at least one support column includes a channel in a lower end thereof, the channel in the lower end of the at least one support column being configured to receive at least partially therein the connection element of the rebar tree.

In some embodiments, the rebar mounting assembly includes one or more branches, each of the one or more branches comprising one or more rebar retention elements.

In some embodiments, the at least one support column includes one or more apertures that extend laterally therethrough between opposing sides thereof, the one or more apertures being configured to have ductwork, pipes, or other conduit passed therethrough.

In another example embodiment, a concrete form includes first and second support columns, a bridge portion, and first and second connection branches. The bridge portion may extend upwardly from and between the first and second support columns to connect the first and second support columns to one another. The bridge portion and the first and second support columns may cooperate to define a channel in a lower surface of the concrete form. The first connection branch may extend upwardly from the first support column. The first connection branch and the bridge portion may cooperate to define a first channel in an upper surface of the concrete form. The second connection branch may extend upwardly from the second support column. The second connection branch and the bridge portion may cooperate to define a second channel in an upper surface of the concrete form.

In some embodiments, each of the first and second connection branches comprises a connection feature that can be configured for connection to second and first connection branches, respectively, of another concrete form.

In some embodiments, at least one of the first and second support columns includes one or more apertures extending laterally therethrough between opposing sides thereof and configured to have ductwork, pipes, or other conduits passed therethrough.

In some embodiments, the first support column includes one or more apertures extending therethrough between the first channel and a lower end of the first support column and/or the second support column includes one or more apertures extending therethrough between the second channel and a lower end of the second support column.

Another example embodiment includes a rebar tree that includes a shaft and a rebar mounting assembly. The rebar mounting assembly may be selectively and movably disposed on the shaft. The rebar mounting assembly includes one or more branches, each having one or more rebar retention elements configured to hold one or more pieces of rebar in one or more desired positions.

In some embodiments, the rebar mounting assembly also includes a sleeve that is configured to be movably disposed on the shaft and the one or more branches are connected to and extending from the sleeve.

In some embodiments, one end of the shaft has a connection element connected thereto.

In some embodiments, an opposite end of the shaft is threaded and the rebar tree includes a bolt configured to be threaded onto the threaded end of the shaft.

In some embodiments, threading the bolt onto the threaded end of the shaft is configured to move the rebar mounting assembly along the shaft towards the connection feature.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A concrete form system, comprising:

a concrete form comprising:

at least one support column disposed at a lower portion of the concrete form, the at least one support column comprising an aperture extending therethrough and a channel in a lower end thereof, the aperture opening into the channel; and first and second connection branches disposed at an upper portion of the concrete form, the first and second connection branches comprising connection features configured to engage corresponding connection features of second and first connection branches, respectively, of other concrete forms, the first and second connection branches at least partially forming one or more channels therebetween, the aperture in the at least one support column opening into the one or more channels at least partially formed by the first and second connection branches; and a rebar tree comprising a rebar mounting assembly, a shaft, and a connection element, wherein:

the shaft is configured to extend through the aperture in the at least one support column to or into the one or more channels at least partially formed by the first and second connection branches and the channel in the lower end of the at least one support column;

the rebar mounting assembly is configured to hold one or more pieces of rebar in one or more desired positions, the rebar mounting assembly being configured to be at least partially disposed within at least one of the one or more channels at least partially formed by the first and second connection branches, the rebar mounting assembly being mountable on a first end of the shaft; and the connection element is positionable at least partially within the channel in the lower end of the at least one support column and connectable to the shaft, wherein the shaft is configured to secure the connection element and the rebar mounting assembly together and hold the rebar mounting assembly and the connection element within their respective channels.

2. The concrete form system of claim 1, wherein the at least one support column comprises first and second support columns.

3. The concrete form system of claim 2, wherein the concrete form further comprises a bridge portion extending between and connecting the first and second support columns.

4. The concrete form system of claim 3, wherein the first and second support columns and the bridge portion cooperate to define a channel in a lower side of the concrete form.

5. The concrete form system of claim 3, wherein the one or more channels at least partially formed by the first and second connection branches comprise first and second channels.

6. The concrete form system of claim 5, wherein the first channel is formed by the first connection branch and the bridge portion and the second channel is formed by the second connection branch and the bridge portion.

7. The concrete form system of claim 1, wherein the connection features of the first and second connection branches comprise mating connection features that are configured to mate with corresponding mating connection features of other concrete forms.

8. The concrete form system of claim 1, wherein the rebar mounting assembly is securable on the shaft and against a bottom surface of the channel at least partially formed by the first and second connection branches by a fastener secured on the shaft.

9. The concrete form system of claim 8, wherein the connection element is fixedly connected to the shaft.

10. The concrete form system of claim 1, wherein selectively mounting the rebar mounting assembly on the shaft is configured to secure the connection element within the channel in the lower end of the at least one support column.

11. The concrete form system of claim 1, wherein the rebar mounting assembly comprises one or more branches, each of the one or more branches comprising one or more rebar retention elements.

12. The concrete form system of claim 1, wherein the at least one support column comprises one or more apertures that extend laterally therethrough between opposing sides thereof, the one or more apertures being configured to have ductwork, pipes, or other conduit passed therethrough.

13. The concrete form system of claim 1, wherein the rebar mounting assembly is selectively and movably disposed on the shaft, the rebar mounting assembly comprising one or more branches, each of the one or more branches comprising one or more rebar retention elements configured to hold the one or more pieces of rebar in the one or more desired positions.

14. The concrete form system of claim 13, wherein the rebar mounting assembly further comprises a sleeve that is configured to be movably disposed on the shaft, the one or more branches being connected to and extending from the sleeve.

15. The concrete form system of claim 13, wherein different branches of the one or more branches have different number so rebar retention elements.

16. The concrete form system of claim 13, wherein an end of the shaft on which the rebar mounting assembly is mountable is threaded, and the rebar tree further comprising a bolt configured to be threaded onto the threaded end of the shaft, wherein threading the bolt onto the threaded end of the shaft is configured to move the rebar mounting assembly along the shaft towards the connection element.

17. A concrete form comprising:

first and second support columns, the first support column comprising a channel in a lower end thereof;

a bridge portion extending upwardly from and between the first and second support columns to connect the first and second support columns to one another, the bridge portion and the first and second support columns cooperating to define a downwardly opening channel in a lower surface of the concrete form, the bridge portion having an upper surface;

a first connection branch extending upwardly from the first support column, the first connection branch and the bridge portion cooperating to define an upwardly opening first channel in an upper surface of the concrete form, the first connection branch having an upper surface; and a second connection branch extending upwardly from the second support column, the second connection branch and the bridge portion cooperating to define a upwardly opening second channel in an upper surface of the concrete form, the second connection branch having an upper surface, the upper surfaces of the bridge, the first connection branch, and the second connection branch being generally coplanar.

18. The concrete form of claim 17, wherein each of the first and second connection branches comprises a connection feature, the connection features of the first and second connection branches being configured for connection to second and first connection branches, respectively, of another concrete form.

19. The concrete form of claim 17, wherein at least one of the first and second support columns comprises one or more apertures extending laterally therethrough between opposing sides thereof, the one or more apertures being configured to have ductwork, pipes, or other conduits passed therethrough.

20. The concrete form of claim 17, wherein the first support column comprises one or more apertures extending therethrough between the first channel and the channel in the lower end of the first support column and/or the second support column comprises one or more apertures extending therethrough between the second channel and a lower end of the second support column.

* * * * *